US005364019A

United States Patent [19]

Björck et al.

[11] Patent Number: 5,364,019

[45] Date of Patent: Nov. 15, 1994

[54] OPENING ARRANGEMENT

[75] Inventors: Bengt Björck, Bjärred; Lars Carlsson, Blentarp, both of Sweden

[73] Assignee: Tetra Laval Holdings & Finance SA, Pully, Switzerland

[21] Appl. No.: 14,256

[22] Filed: Feb. 5, 1993

[30] Foreign Application Priority Data

Feb. 11, 1992 [SE] Sweden ..... 9200391

[51] Int. Cl.[5] ..... B65D 5/72

[52] U.S. Cl. ..... 229/125.09; 229/125.14; 229/125.15

[58] Field of Search ..... 229/125.04, 125.08, 229/125.09, 125.14, 125.15

[56] References Cited

U.S. PATENT DOCUMENTS

| | | | |
|---|---|---|---|
| 2,533,305 | 12/1950 | Wells | 229/125.15 |
| 3,977,591 | 8/1976 | Martensson et al. | 229/125.09 |
| 4,770,325 | 9/1988 | Gordon et al. | 229/125.09 |
| 4,815,655 | 3/1989 | Jacobsson et al. . | |
| 4,819,839 | 4/1989 | Carlsson et al. . | |
| 4,838,428 | 6/1989 | Rausing . | |
| 4,913,294 | 4/1990 | Giacomelli . | |
| 4,930,683 | 6/1990 | Färber . | |
| 4,986,465 | 1/1991 | Jacobsson et al. . | |
| 5,065,938 | 11/1991 | Anderson . | |
| 5,067,614 | 11/1991 | Jönsson | 229/125.09 |
| 5,101,999 | 4/1992 | Robichaud et al. | 229/125.09 |
| 5,110,041 | 5/1992 | Keeler | 229/125.14 |

FOREIGN PATENT DOCUMENTS

| | | | |
|---|---|---|---|
| 0310180 | 4/1989 | European Pat. Off. . | |
| 0340339 | 11/1989 | European Pat. Off. . | |
| 0444862 | 9/1991 | European Pat. Off. . | |
| 363931 | 9/1962 | Switzerland | 229/125.04 |
| 90/14280 | 11/1990 | WIPO . | |
| 92/00884 | 1/1992 | WIPO . | |

*Primary Examiner*—Gary E. Elkins

*Attorney, Agent, or Firm*—Burns, Doane, Swecker & Mathis

[57] ABSTRACT

The disclosure relates to a method of providing a liquid package (2) with an opening arrangement (1) and to the opening arrangement (1) proper. A hole (3) is punched out in the material (15) of a package (2) of the type which is produced from a material web (15) or a material sheet, the hole being covered by a thin strip (4). Thereafter, the package (2) is filled and formed into its final shape. A plastic device (6) is secured on the finished package (2) so that it surrounds the strip (4) without covering it. The plastic device (6) consists of a pouring element (7) with an angled front edge (10) and a sealing element (8) with a locking angle (13). A hole is provided in the pouring element (7) wherein the strip (4) is visible in its entirety.

Before distribution of the package (2) the sealing element (8) is moved over the pouring element (7) so that these enter into engagement with one another and the locking angle (13) is locked against the front edge (10) of the pouring element (7).

18 Claims, 2 Drawing Sheets

OPENING ARRANGEMENT

TECHNICAL FIELD

The present invention relates to a method of providing a liquid package manufactured from a material web or a material sheet with an opening arrangement, by punching, in the material, a hole or hole indication which is sealed by means of a strip.

The present invention also relates to an opening arrangement for liquid packages manufactured from a material web or a material sheet, comprising a hole or hole indication punched out in the material and sealed, prior to filling and forming of the package, by means of a strip.

BACKGROUND ART

In the packaging industry, work is constantly in progress on opening arrangements for improving opening facility, pouring properties, sealing and various types of protection against unauthorized opening of the package. The type of package which is manufactured from a laminate consisting of a paper or cardboard core with thermoplastic and possibly aluminium foil can be produced from a continuous material web or from individual blanks. When a continuous material web is employed, the material web is formed into a tube which is filled with the liquid contents intended for packing, is sealed and cut off into individual packages and is then finally formed into a finished carton or package. The blanks consist of ready-folded and jointed carton blanks which are filled and thereafter sealed and finally formed.

Providing these liquid packages with outer plastic devices is known in the art, for instance from Patent Specification WO 90/14280. These outer plastic devices can be provided with pouring spouts and different types of seals. In order to open the package provided with such a plastic device, various methods have been proposed in the patent literature. The simplest method is a perforation which is forced down using the thumb. This method is unhygienic and there is a risk of spillage when the package is completely filled. Another method is that a portion of the outer plastic device is urged down into the package on opening. In such instance, there is the risk that fibres from the packaging laminate accompany the portion of the plastic device down into the contents of the package and contaminate the enclosed liquid food.

OBJECTS OF THE INVENTION

One object of the present invention is to manufacture a package with an opening arrangement which has superior properties as regards opening, pouring and sealing. A further object of the present invention is to ensure the consumer that the package cannot have been tampered with or improperly opened.

Yet a further object of the present invention is to ensure that the opening surface is shielded against dust on distribution of the package. In addition, the opening arrangement prevents fibres from being loosened on opening and falling down into the contents of the package.

SOLUTION

These and other objects have been attained according to the present invention in that the method of the type described by way of introduction has been given the characterizing features that, after filling and forming of the package, a thermoplastic device consisting of a pouring element and a sealing element is sealed against the outside of the package, around the strip, and that the sealing element is folded over the pouring element.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which:

FIGS. 1 A–E show the method according to the present invention step-by-step;

Figure 1A:
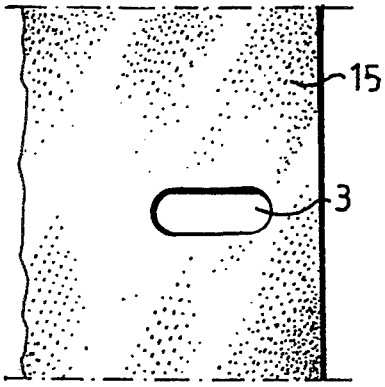
Figure 1B:
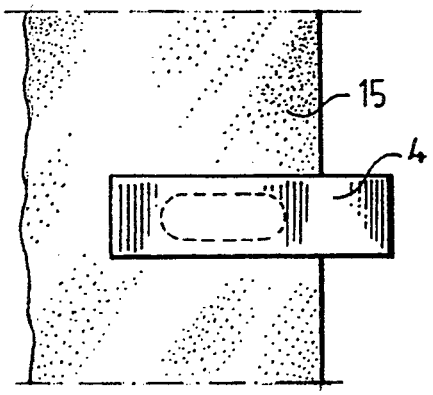
Figure 1C:
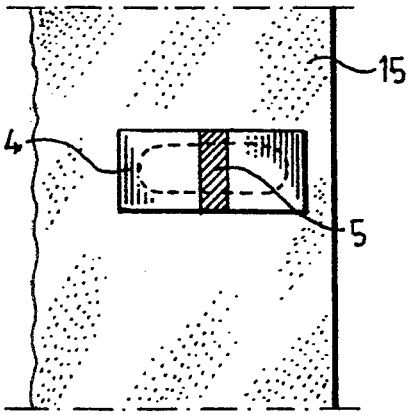
Figure 1D:
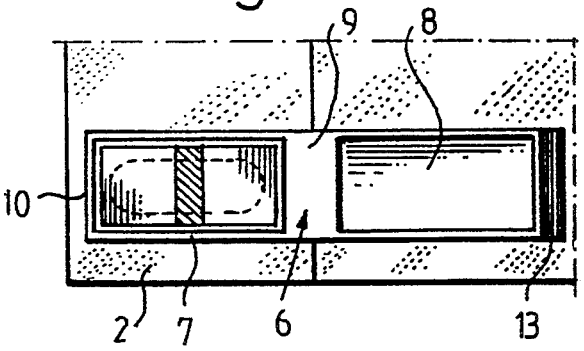
Figure 1E:
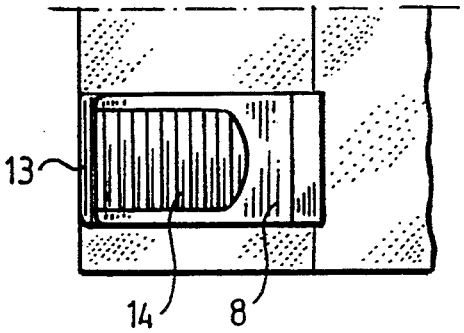

The accompanying Drawings show only those details essential to an understanding of the present invention.

DESCRIPTION OF PREFERRED EMBODIMENT

The present invention is a method of providing liquid packages 2 with an opening arrangement 1 as shown in FIGS. 1 A–E. The opening arrangement 1 is preferably intended for that type of single-use disposable package 2 which is manufactured from a laminate with a paper or cardboard core to which are laminated thermoplastics and possibly an aluminium foil layer. This packaging laminate may occur in the form of a material web 15 or be punched out into individual sheets which are ready-folded and partly sealed, so-called blanks. The opening arrangement 1 according to the present invention is particularly well suited for that type of package 2 which is produced from a continuous material web 15, since no disruptive parts are supplied to the web so that production of the packages 2 in the machine is interfered with, or so that sterilization of the packages 2 is impeded.

The packaging material web 15 or the packaging sheet blank is provided with a punched hole 3 as shown in FIG. 1 A. In the preferred embodiment, one hole 3 has been punched out so, on opening, no fibres from the packaging material risk falling down into the contents of the package 2.

The punched hole 3 or hole indication is covered with an aluminium foil strip 4 laminated with thermoplastic (FIG. 1 B), a so-called pull-tab. The pull-tab 4 is sealed over the punched hole 3 or hole indication. A part of the pull-tab 4 is left unsealed so as to enable the consumer to grasp the pull-tab 4 when the package 2 is to be opened. The unsealed portion of the pull-tab 4 may possibly be made longer and folded back over the sealed portion of the full-tab 4 (FIG. 1 C). Ideally, the unsealed section of the pull-tab 4 is provided with a colour marking 5 so as to indicate where tearing-off of the pull-tab 4 is to be commenced. The thin pull-tab strip 4 (even when possibly folded double over the sealed portion) is so thin that it does not disrupt the passage of the packaging material web 15 through, for example, a sterile bath and other sensitive parts of the packing and filling machine.

When a packaging material web 15 is employed, this is formed into a tube which is filled with that liquid which is to be packed, and the tube is cut off to form individual packages 2 which are thereafter finally formed. The packaging blanks are raised, sealed at the bottom, filled and then top-sealed and finally formed. Whether use is made of a continuous material web 15 or package blanks, the result will now be a ready-formed and filled package 2 with a conventional so-called pull-tab opening in which the unsealed section of the pull-tab 4 may be unfolded or folded over the sealed pull-tab section. The package 2 is now provided with an outer plastic device 6. This plastic device 6 is injection moulded in thermoplastic and is applied on the outside of the pull-tab opening (FIG. 1 D).

The plastic device 6 consists of a pouring element 7 and a sealing element 8. These may be joined together to form a plastic device 6 injection moulded in one and the same operation, but they may also be two separate parts joined together, with some form of hinge. If the plastic device 6 consists of a single plastic part, the continuous bridge 9 between the pouring element 7 and the sealing element 8 is relatively thin and constitutes, when folded, a simple form of hinge.

An opening is provided in the pouring element 7 and covers the greater part of the pouring element 7. The underface of the pouring element 7 may be provided with thin thermoplastic grooves and ridges which, on heating, melt more quickly than the homogeneous parts of the underface of the pouring element 7. When the plastic device 6 is to be attached over the pull-tab opening, both the package surface over the pull-tab 4 and the underface of the pouring element 7 with its thin plastic grooves and ridges are heated. The plastic device 6 is pressed in place against the face of the package 2 over the pull-tab opening. In such instance, precise accuracy is necessary in order that the pull-tab 4 is freely disposed in the opening which the pouring element 7 has on its underface. The plastic device 6 may also be secured to the surface of the package 2 with some form of added sealant, such as hot melt adhesion. After securement and cooling of the plastic device 6, the sealing element 8 is moved over the pouring element 7 and the opening arrangement is sealed completely and dust-tight, the package 2 now being ready for distribution.

The plastic device 6 may naturally be designed in many different ways. In the preferred embodiment, a pouring element 7 has been selected which is relatively high and does not project beyond the end wall of the package 2. The outer edge 10 of the pouring element 7 is somewhat angled so as to facilitate the pouring operation. The sides 11 of the pouring element 7 are flush with the outer edge 10 in order more readily to guide the liquid stream on pouring. In the preferred embodiment, the pouring element 7 is connected to the sealing element via a thin plastic bridge 9. In such instance, this plastic bridge 9 will serve as a rudimentary hinge when the sealing element 8 is moved over the pouring element 7. Of course, many different types of hinge designs and constructions are conceivable here, such that the pouring element 7 and the sealing element 8 are manufactured in two separate parts. The sealing element 8 is designed such that it enters into engagement with the pouring element 7 and has, in its outer edge 12, a slightly angled part 13 which is locked against the outer edge 10 of the pouring element 7. The upper face of the sealing element 8 can be provided with different forms of grooves 14 or patterns so as to afford better grip on opening of the package.

Figure 2:
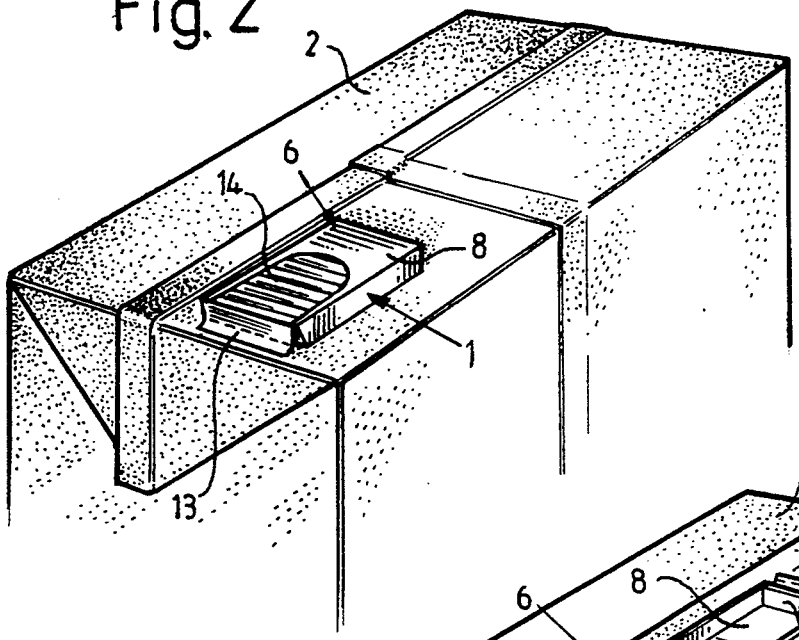
FIG. 2 shows a part of a package container with an unopened opening arrangement according to the present invention.
Figure 3:
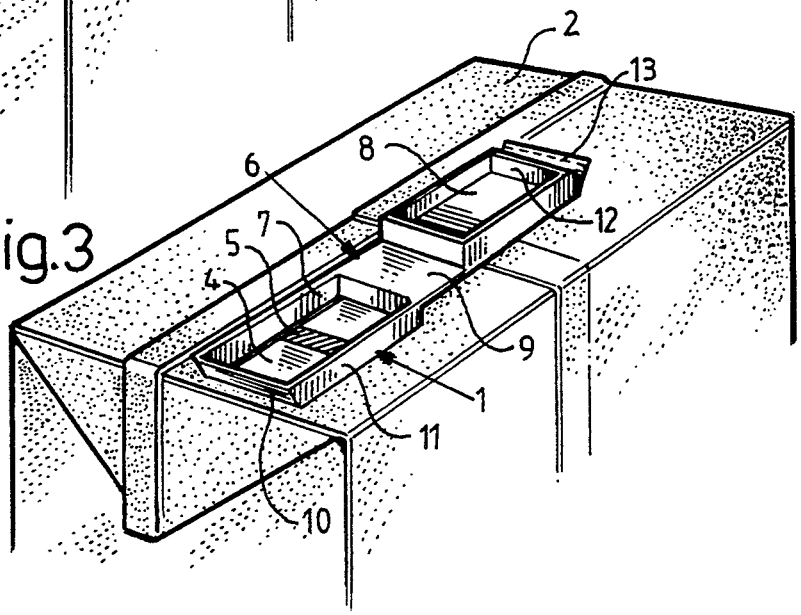
FIG. 3 shows a portion of a package container in which the sealing element is opened.

When the consumer receives a package 2 with an opening arrangement 1 according to the present invention, the opening pull-tab is protected by the sealing element 8 of the plastic device 6 as illustrated in FIG. 2. In FIG. 3, the sealing element 8 has been raised and lies in its raised position along the upper side of the package 2. The pull-tab strip 4 is now visible in the bottom opening of the pouring element 8. In FIG. 3, the pull-tab 4 is partly folded back over the sealed section of the pull-tab 4 and the hatched centre panel represents a colour indication 5 where tearing of the pull-tab 4 is to be commenced. If it is chosen not to fold the pull-tab 4 over, a larger plastic device 6 will be necessary in which the unsealed section of the pull-tab 4 is also accommodated without the outer plastic device 6 being fixedly sealed against it. The pull-tab strip 4 constitutes a guarantee that no-one has tampered with the packaging container or improperly opened it.

Figure 4:
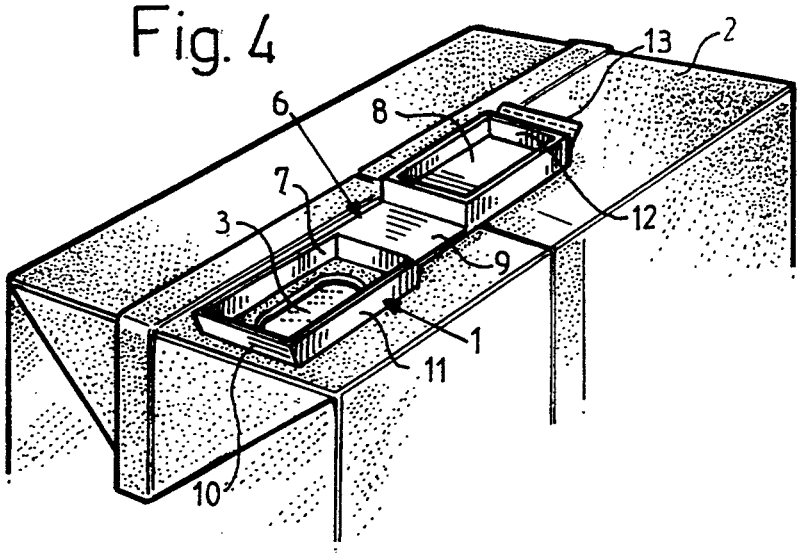
FIG. 4 shows a portion of a package container in which the opening arrangement has been fully opened.

FIG. 4 shows the package 2 with the pull-tab 4 torn off and, in the open bottom portion of the pouring element 7 the punched hole 3 can be seen (or possibly the hole after the hole indication which accompanies the pull-tab strip 4 when this is torn off). The package 2 is now ready for pouring and, in this operation, considerable assistance is afforded by the design of the pouring element 7 with its angled outer edge 10 and high guiding sides 11. Above all, the sensitive final phase of pouring is facilitated and unnecessary spillage is avoided. After completed pouring of the contents of the package 2, the sealing element 8 is once again moved back in place over the pouring element 7 and enters into engagement therewith, with its angled locking part 13.

As is apparent from the foregoing description, the present invention realizes an opening arrangement which enjoys superior properties as regards pouring and resealing. In addition, the consumer can rest assured that no-one has improperly opened the package or tampered with it.

The present invention should not be considered as restricted to that described above and shown on the Drawings, many modifications being conceivable without departing from the spirit and scope of the appended Claims.

What is claimed is:

1. An arrangement for opening and discharging the contents of a package that is manufactured from a material web, the arrangement comprising:

a hole in the material web through which contents of the package may be poured;

a sealing strip, the sealing strip being sealed to a first side of the material web over the hole;

a pouring element, the pouring element having a side wall, a bottom end of the side wall extending around the hole, the pouring element being sealed to the first side of the material web, the sealing strip being at least partially positioned within the side wall; and a sealing element, the sealing element being movable to seal and unseal a top end of the pouring element;

whereby the sealing strip may be grasped through the pouring element within the side wall and pulled to unseal the hole after the sealing element is moved to unseal the top end of the pouring element.

2. The arrangement as claimed in claim 1, wherein the material web includes a laminate including thermoplastic.

3. The arrangement as claimed in claim 1, wherein the pouring element engages with the sealing element to seal the arrangement.

4. The arrangement as claimed in claim 1, wherein the pouring element and the sealing element are an integral piece.

5. The arrangement as claimed in claim 1, wherein the pouring element and the sealing element are two separate parts and are joined together by a hinge.

6. The arrangement as claimed in claim 1, wherein the pouring element is sealed against the material web such that the strip is entirely disposed within the opening.

7. The arrangement as claimed in claim 1, wherein after the plastic device is sealed against the material, the sealing element is passed over the pouring element and is locked thereagainst.

8. The arrangement as claimed in claim 1, wherein the pouring element and the sealing element are formed of a thermoplastic material.

9. The arrangement as claimed in claim 1, wherein thermoplastic material ridges are formed on a bottom surface of the pouring element.

10. The arrangement as claimed in claim 1, wherein the pouring device is sealed to the material with a hot melt adhesive.

11. The arrangement as claimed in claim 4, wherein a portion of the sealing element forms a hinge between the sealing element and the pouring element.

12. The arrangement as claimed in claim 1, wherein the sealing strip is formed from a metal foil strip laminated with thermoplastic material.

13. The arrangement as claimed in claim 1, wherein an outer edge portion of the pouring element is angled to facilitate pouring.

14. The arrangement as claimed in claim 13, wherein the sealing element includes a second outer edge portion engageable with the outer edge portion of the pouring element.

15. The arrangement as claimed in claim 14, wherein the second outer edge portion includes an angled portion for locking with the outer edge portion of the pouring element.

16. The arrangement as claimed in claim 1, wherein the sealing element includes a pattern on a top side of the sealing element facilitating gripping of the sealing element.

17. An arrangement for opening and discharging the contents of a package that is manufactured from a material web, the arrangement comprising:

a hole in the material web through which contents of the package may be poured;

a sealing strip, the sealing strip being sealed to the material web over the hole, the sealing strip including an unsealed section which is folded over a sealed section of the sealing strip, the sealed section being sealed to the material web;

a pouring element, the pouring element having a side wall, a bottom end of the side wall extending around the hole, the pouring element being sealed to the material web, the sealing strip being at least partially positioned within the side wall; and a sealing element, the sealing element being movable to seal and unseal a top end of the pouring element.

18. The arrangement as claimed in claim 17, wherein a color marking is applied to a free end of the unsealed section.

* * * * *